US009742068B2

(12) United States Patent
Hsu et al.

(10) Patent No.: US 9,742,068 B2
(45) Date of Patent: Aug. 22, 2017

(54) MICROSTRIP ANTENNA TRANSCEIVER

(71) Applicant: Wistron NeWeb Corporation, Hsinchu (TW)

(72) Inventors: Chieh-Sheng Hsu, Hsinchu (TW); Chang-Hsiu Huang, Hsinchu (TW); Cheng-Geng Jan, Hsinchu (TW)

(73) Assignee: Wistron NeWeb Corporation, Hsinchu (TW)

( * ) Notice: Subject to any disclaimer, the term of this patent is extended or adjusted under 35 U.S.C. 154(b) by 1019 days.

(21) Appl. No.: 13/831,918

(22) Filed: Mar. 15, 2013

(65) Prior Publication Data

US 2014/0203968 A1 Jul. 24, 2014

(30) Foreign Application Priority Data

Jan. 21, 2013 (TW) ..... 102102223 A

(51) Int. Cl.
*H01Q 3/02* (2006.01)
*H01Q 9/06* (2006.01)
(Continued)

(52) U.S. Cl.
CPC ..... *H01Q 9/065* (2013.01); *H01Q 9/0407* (2013.01); *H01Q 21/0006* (2013.01); *H01Q 3/24* (2013.01); *H01Q 9/0442* (2013.01); *H01Q 9/285* (2013.01)

(58) Field of Classification Search
CPC ..... H01Q 3/24; H01Q 21/0006; H01Q 9/065; H01Q 9/285; H01Q 9/0407
(Continued)

(56) References Cited

U.S. PATENT DOCUMENTS 4,410,891 A * 10/1983 Schaubert ..... H01Q 21/245 343/700 MS
5,270,722 A * 12/1993 Delestre ..... H01Q 9/0414 343/700 MS
(Continued)

FOREIGN PATENT DOCUMENTS

CN 202363587 U 8/2012
EP 2065974 A1 6/2009
(Continued)

OTHER PUBLICATIONS

S. Gao, L. W. Li, M. S. Leong, and T. S. Yeo, "A Broad-Band Dual-Polarized Microstrip Patch Antenna With Aperture Coupling" IEEE Transactions on Antennas and Propagation, vol. 51, No. 4, Apr. 2003, p. 898-900.
(Continued)

*Primary Examiner* — Chuong P Nguyen
(74) *Attorney, Agent, or Firm* — Winston Hsu

(57) ABSTRACT

A microstrip antenna transceiver with switchable polarization, used in a satellite signal reception device, includes a base board, having a first surface and a second surface; a ground metal plate, disposed on the first surface of the base board; an antenna module, disposed on the ground metal plate, having a radiating metal patch, a vertically polarized feeding hole and a horizontally polarized feeding hole; a first switch, set on the second surface of the base board; a second switch, set on the second surface of the base board; a first microstrip wire, electrically connected between the vertically polarized feeding hole of the antenna module and the first switch; and a second microstrip wire, electrically connected between the horizontally polarized feeding hole of the antenna module and the second switch.

14 Claims, 10 Drawing Sheets

(51) Int. Cl.

| | |
|---|---|
| ***H01Q 9/04*** | (2006.01) |
| ***H01Q 21/00*** | (2006.01) |
| *H01Q 3/24* | (2006.01) |
| *H01Q 9/28* | (2006.01) |

(58) Field of Classification Search
USPC ..... 342/374, 876; 343/876
See application file for complete search history.

(56) References Cited

U.S. PATENT DOCUMENTS

| | | | | |
|---|---|---|---|---|
| 5,706,015 | A | 1/1998 | Chen | |
| 6,335,703 | B1 | 1/2002 | Chang | |
| 6,492,947 | B2 * | 12/2002 | Anderson | H01Q 9/0457 343/700 MS |
| 7,053,833 | B2 * | 5/2006 | Hsu | H01Q 1/38 343/700 MS |
| 7,253,770 | B2 | 8/2007 | Yegin | |
| 7,327,317 | B2 * | 2/2008 | Heiniger | H01Q 1/241 343/700 MS |
| 7,391,377 | B2 * | 6/2008 | Matsushita | H01Q 3/44 343/700 MS |
| 7,423,595 | B2 | 9/2008 | Säily | |
| 7,432,862 | B2 | 10/2008 | Heyde | |
| 7,535,326 | B2 | 5/2009 | Nakatani | |
| 7,609,211 | B2 * | 10/2009 | Hsu | H01Q 9/0421 343/700 MS |
| 7,952,525 | B2 * | 5/2011 | Hirabayashi | H01Q 21/24 343/700 MS |
| 8,373,609 | B1 | 2/2013 | Dorsey | |
| 8,564,484 | B2 * | 10/2013 | Jan | H01Q 9/0414 343/700 MS |
| 8,648,770 | B2 * | 2/2014 | Schneider | H01Q 3/247 343/893 |
| 8,698,575 | B2 * | 4/2014 | Bloy | H01P 5/02 333/101 |
| 9,024,839 | B2 * | 5/2015 | Schneider | H01Q 3/247 343/893 |
| 2007/0229359 | A1 | 10/2007 | Heyde | |
| 2008/0266192 | A1 | 10/2008 | Tuttle | |
| 2011/0032079 | A1 * | 2/2011 | Bloy | H01P 5/02 340/10.1 |
| 2014/0320376 | A1 * | 10/2014 | Ozdemir | H01Q 9/0442 343/876 |
| 2016/0211580 | A1 * | 7/2016 | Hsu | H01Q 21/245 |

FOREIGN PATENT DOCUMENTS

| | | |
|---|---|---|
| JP | 200579838 A | 3/2005 |
| TW | 477091 | 2/2002 |
| TW | 200818599 | 4/2008 |
| TW | 200929693 | 7/2009 |
| TW | 201431302 A | 8/2014 |

OTHER PUBLICATIONS

Andrea Vallecchi and Guido Biffi Gentili, "A Shaped-Beam Hybrid Coupling Microstrip Planar Array Antenna for X-Band Dual Polarization Airport Surveillance Radars" Antennas and Propagation, 2007. EuCAP 2007. The Second European Conference on Nov. 11-16, 2007.

Chieh-Sheng Hsu et al., Title: Planar Dual Polarization Antenna and Complex Antenna, pending U.S. Appl. No. 14/700,150, filed Apr. 30, 2015.

E. Ramola et al., "Reconfigurable Microstrip Patch Antenna using MEMS Technology," IOSR Journal of Electronics and Communication Engineering (IOSR-JECE), vol. 4, Issue 4 (Jan.-Feb. 2013), pp. 44-51.

H. Rajagopalan et al., "Reconfigurable Patch-Slot Reflectarray Elements using RF MEMS Switches: A Subreflector Wavefront Controller," IEEE Antennas and Propagation Society International Symposium, 2007, pp. 5203-5206.

* cited by examiner

MICROSTRIP ANTENNA TRANSCEIVER

BACKGROUND OF THE INVENTION

1. Field of the Invention

The present invention is related to a microstrip antenna transceiver, and more particularly, to a microstrip antenna transceiver which is capable of switching polarizations.

2. Description of the Prior Art

Satellite communication has advantages of huge coverage and no interference caused by ground environment, and is widely used in military applications, detection and commercial communications services, such as satellite navigation, a satellite voice broadcast system or a satellite television broadcast system. Nowadays, many electronic devices, such as smart phones, tablet personal computers, and so on can receive satellite signals via an external antenna. In general, the frequency of satellite signals ranges from 1.467 GHz to 1.492 GHz and two orthogonal signals are provided within the band at the same time, wherein one of the orthogonal signals is a left-handed polarized signal and the other is right-handed polarized signal. Therefore, a left-handed polarized antenna module and a right-handed polarized antenna module are required to receive the two orthogonal signals. However, practically, an electronic device does not handle the two orthogonal signals at the same time and only selects one. Moreover, two independent antenna modules occupy much space and increase the cost, so that the left-handed polarized antenna module and the right-handed polarized antenna module can be combined to one antenna module.

Please refer to FIG. 1, which is a schematic diagram of an antenna transceiver 10 according to the prior art. The antenna transceiver 10 is a switchable antenna transceiver with left-handed and right-handed polarizations and comprises a first switch 100, a second switch 102, a hybrid circuit 104 and a patch antenna 106, wherein the patch antenna 106 has vertical and horizontal space symmetry. The hybrid circuit 104 has four transmit ports P1-P4, in which the transmit ports P1 and P4 respectively connect to the first switch 100 and the second switch 102, and the transmit ports P2 and P3 respectively connect to the patch antenna 106 with vertical and horizontal polarizations.

In brief, for the transmitting operations, the first switch 100 and the second switch 102 control a signal S to enter the hybrid circuit 104 via the transmit port P1 or P4. The hybrid circuit 104 equally partitions the signal S into two transmit signals with a phase difference of 90 degrees, and follows to transmit the two transmit signals to the patch antenna 106. Then, the patch antenna 106 generates a vertically polarized signal SV and a horizontally polarized signal SH and radiates the vertically polarized signal SV and the horizontally polarized signal SH on the air. The patch antenna 106 has two feeding holes so that the two transmit signals equally partitioned from the signal S enter the two feeding holes to generate vertically polarized and horizontally polarized electromagnetic fields. Besides, since the vertical and horizontal spaces of the patch antenna 106 are symmetric, the energy of the vertically polarized signal SV and the horizontally polarized signal SH are not mutually affected. In other words, the patch antenna 106 has high isolation between the two polarized signals. In addition, the phase difference of the outputted signals from the transmit ports P2 and P3 is 90 degrees, so that the antenna transceiver 10 can generate a left-handed polarized or right-handed polarized antenna pattern. In detail, due to the characteristics of the hybrid circuit 104, when the signal S enters the hybrid circuit 104 via P1, the signal S has less energy reflected back to the transmit port P1 and less energy entered into P4. Therefore, the hybrid circuit 104 can equally partition the signal S with the 90-degree phase difference and transmit the equally partitioned signals to the patch antenna 106 via the transmit ports P2 and P3. Since the phase of the outputted signal via the transmit port P2 leads 90 degrees to that of the outputted signal via the transmit port P3, the patch antenna 106 can respectively generate the vertically polarized electromagnetic radiation and horizontally polarized electromagnetic radiation after receiving the outputted signals via the transmit ports P2 and P3, and further generate the left-handed polarized antenna pattern. For the same reason, if the signal S enters the hybrid circuit 104 via the transmit port P4, the hybrid circuit 104 can also equally partition the signal S into two signals and transmit the two signals to the patch antenna 106 via the transmit ports P2 and P3. Since the outputted signal via the transmit port P2 lags 90 degrees to the outputted signal via the transmit port P3, the patch antenna 106 can respectively generate the vertically polarized electromagnetic radiation and horizontally polarized electromagnetic radiation after receiving the outputted signals via the transmit ports P2 and P3, and further generate the right-handed polarized antenna pattern. In addition, the first switch 100 and the second switch 102 are used for controlling the transmit ports which the signal enters, to further control the antenna pattern generated by the antenna transceiver 10.

For receiving operations, the antenna transceiver 10 can also control the transmit port P1 or P4 to transmit the left-handed polarized or right-handed polarized signal received from the patch antenna 106 to a backend circuit module (which is not illustrated in FIG. 1) via the first switch 100 and the second switch 102. Besides, in comparison with the transmitting operations, the first switch 100 and the second switch 102 should rotate 180 degrees to conform the signal transmission direction.

As seen above, the conventional antenna transceiver 10 has high isolation for two orthogonal signals. However, the length and width of the hybrid circuit 104 need to be ¼ wavelength in order to perform the hybrid circuit, so that the hybrid circuit requires large plate area and the cost is increased for the low frequency of the present satellite signals. Therefore, how to reduce the cost of the antenna and handle the two orthogonal signals at the same time becomes a goal in the industry.

SUMMARY OF THE INVENTION

The present invention therefore provides a microstrip antenna transceiver which is capable of switching polarizations.

A microstrip antenna transceiver with switchable polarization, used in a satellite signal reception device, is disclosed. The microstrip antenna transceiver comprises a base board, comprising a first surface and a second surface; a ground metal plate, disposed on the first surface of the base board; an antenna module, disposed on the ground metal plate, comprising a radiating metal patch, a vertically polarized feeding hole and a horizontally polarized feeding hole; a first switch, set on the second surface of the base board; a second switch, set on the second surface of the base board; a first microstrip wire, electrically connected between the vertically polarized feeding hole of the antenna module and the first switch; and a second microstrip wire, electrically connected between the horizontally polarized feeding hole of the antenna module and the second switch.

These and other objectives of the present invention will no doubt become obvious to those of ordinary skill in the art after reading the following detailed description of the preferred embodiment that is illustrated in the various figures and drawings.

Figure 7:
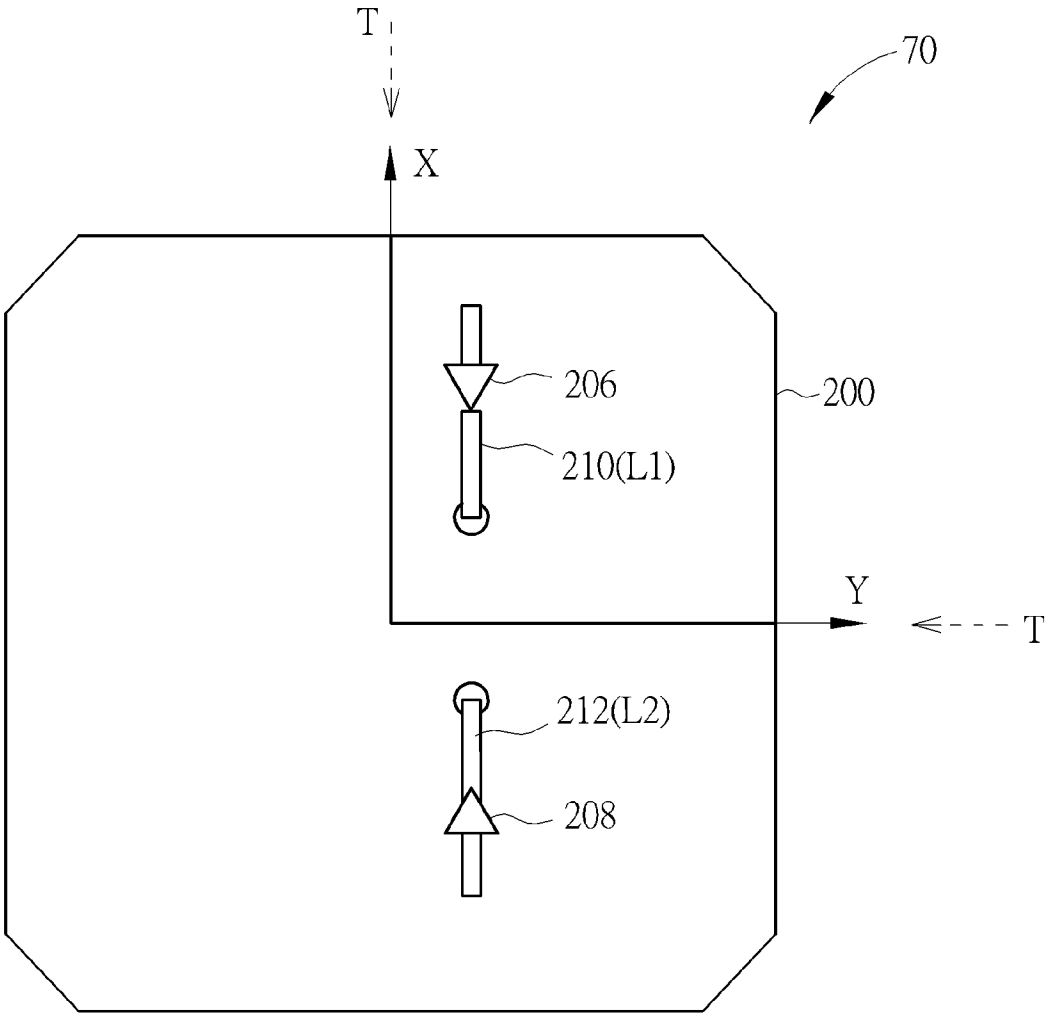
FIG. 7 is a schematic diagram of a back of a microstrip antenna transceiver according to an embodiment of the present invention.
Figure 8:
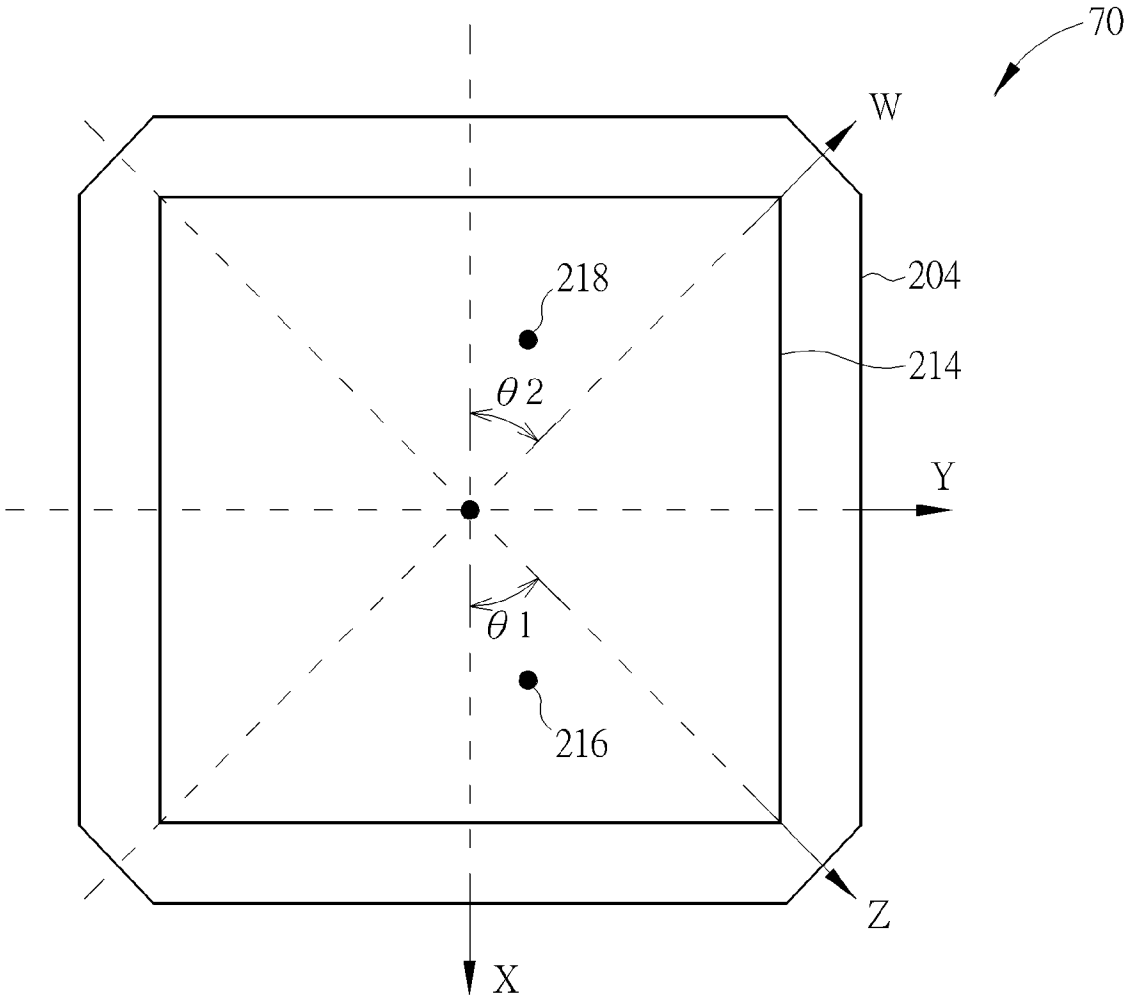

The FIG. 8 is a schematic diagram of a front of the microstrip antenna transceiver in FIG. 7.

Figure 9:
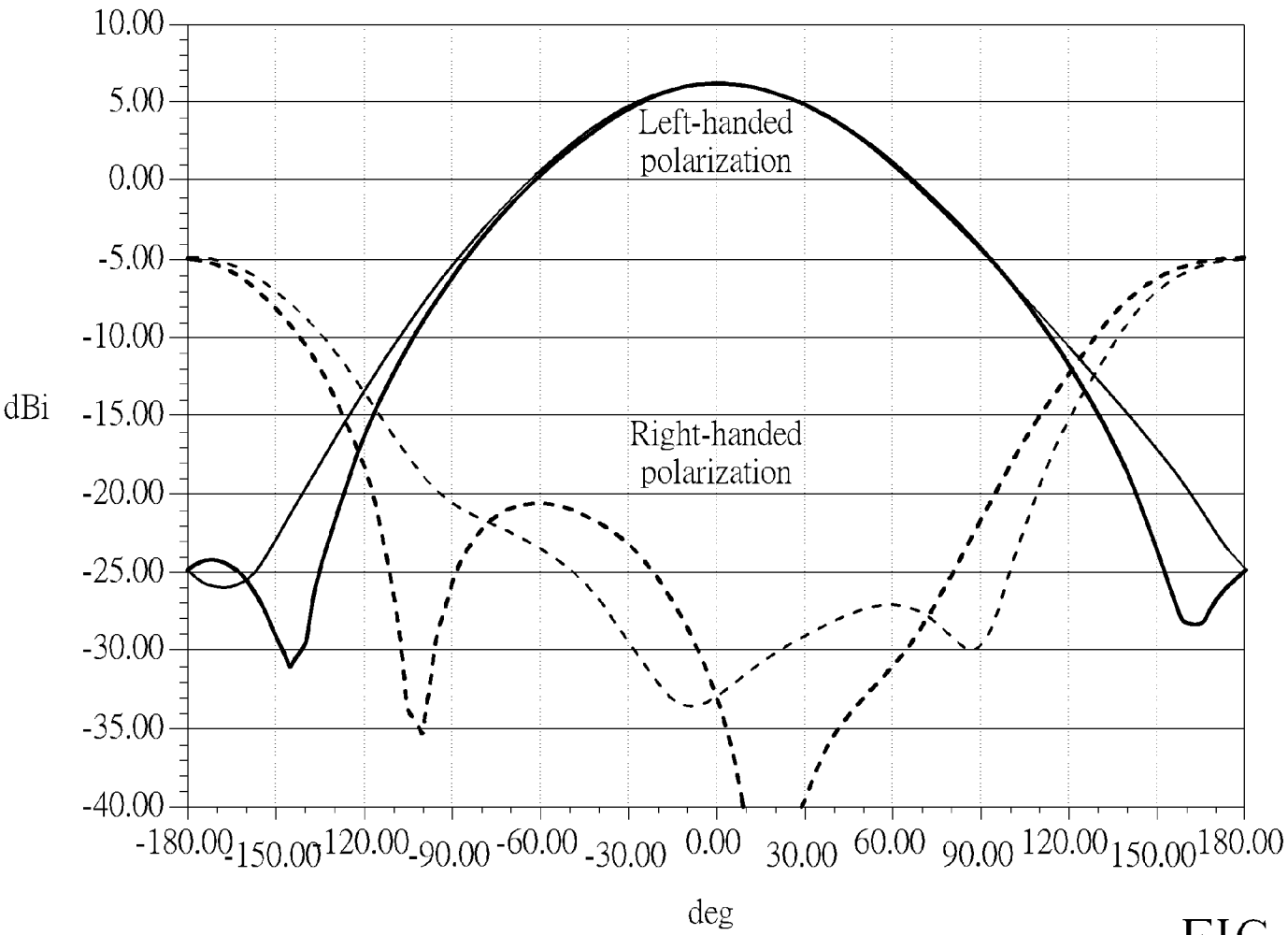

FIG. 9 is a schematic diagram of the antenna pattern of the microstrip antenna transceiver feeding the signal into the first switch in FIG. 7.

Figure 10:
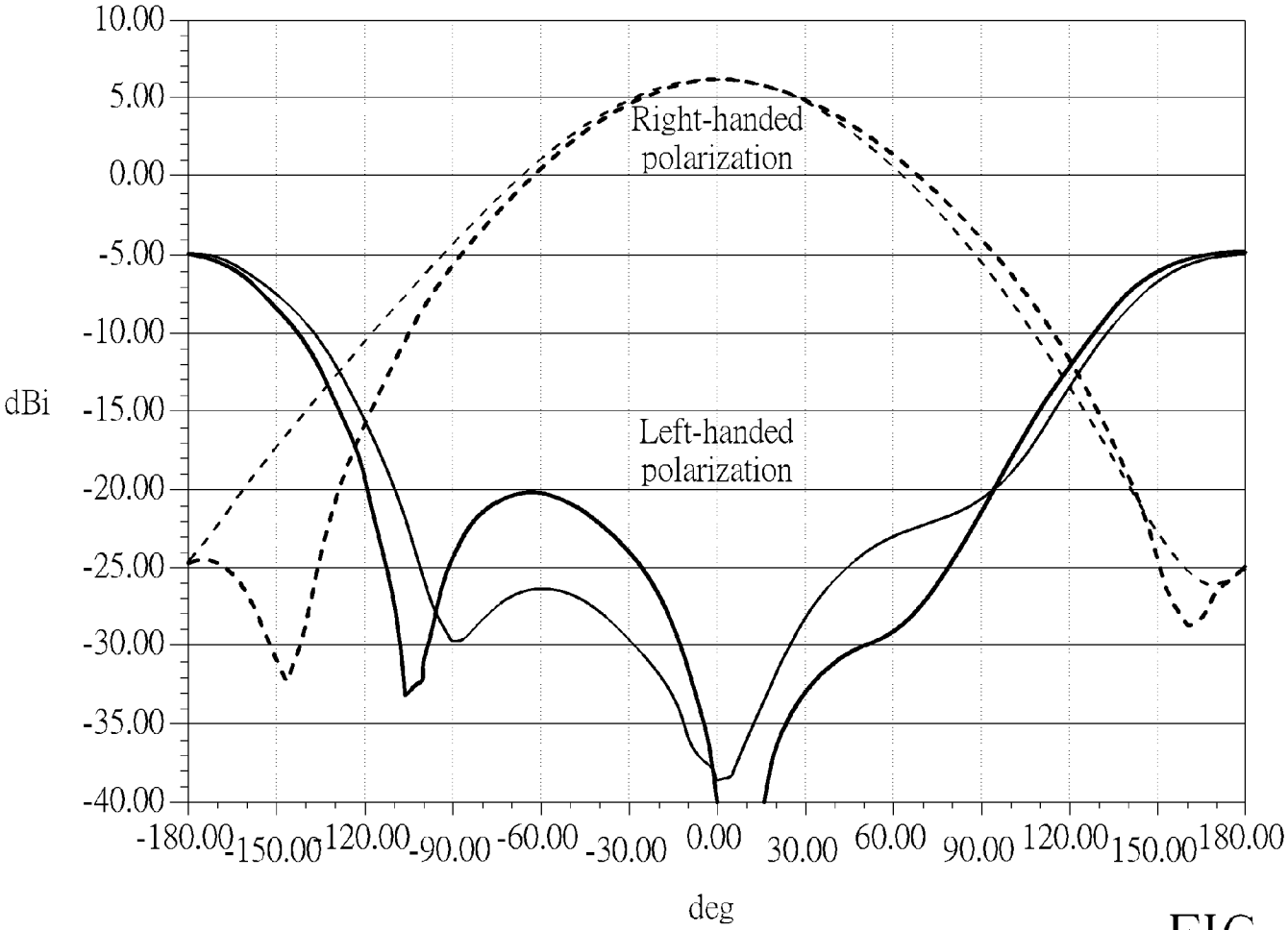

FIG. 10 is a schematic diagram of the antenna pattern of the microstrip antenna transceiver feeding the signal into the second switch FIG. 7.

DETAILED DESCRIPTION

Figure 1:
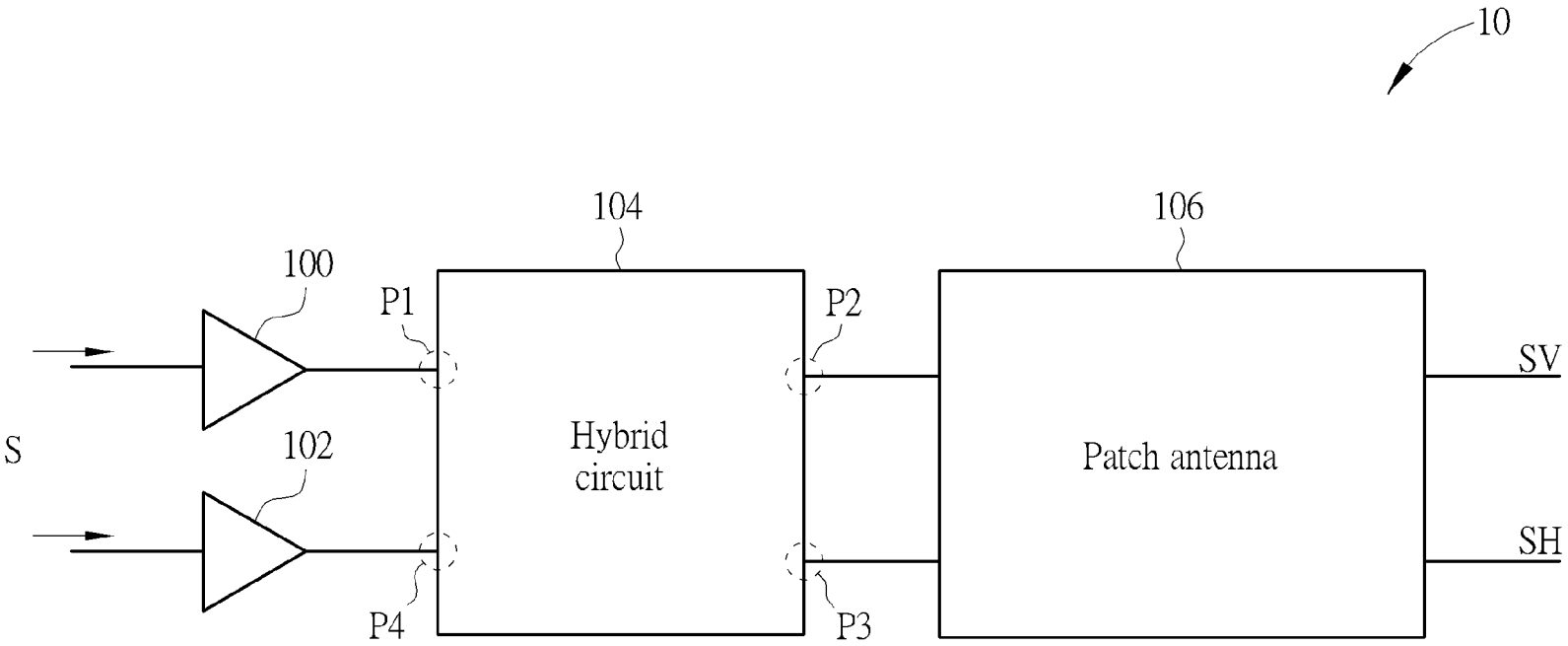
FIG. 1 PRIOR ART
FIG. 1 is a schematic diagram of an antenna transceiver according to the prior art.
Figure 2:
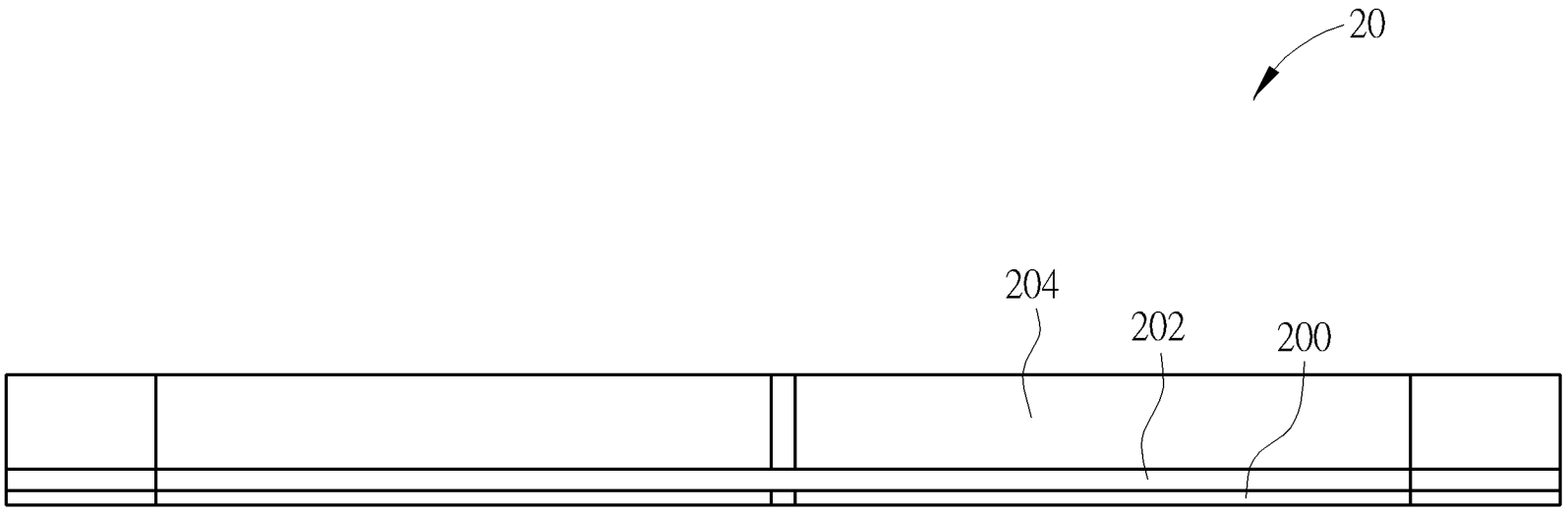
FIG. 2 is a schematic diagram of aside of a microstrip antenna transceiver according to an embodiment of the present invention.
Figure 3:
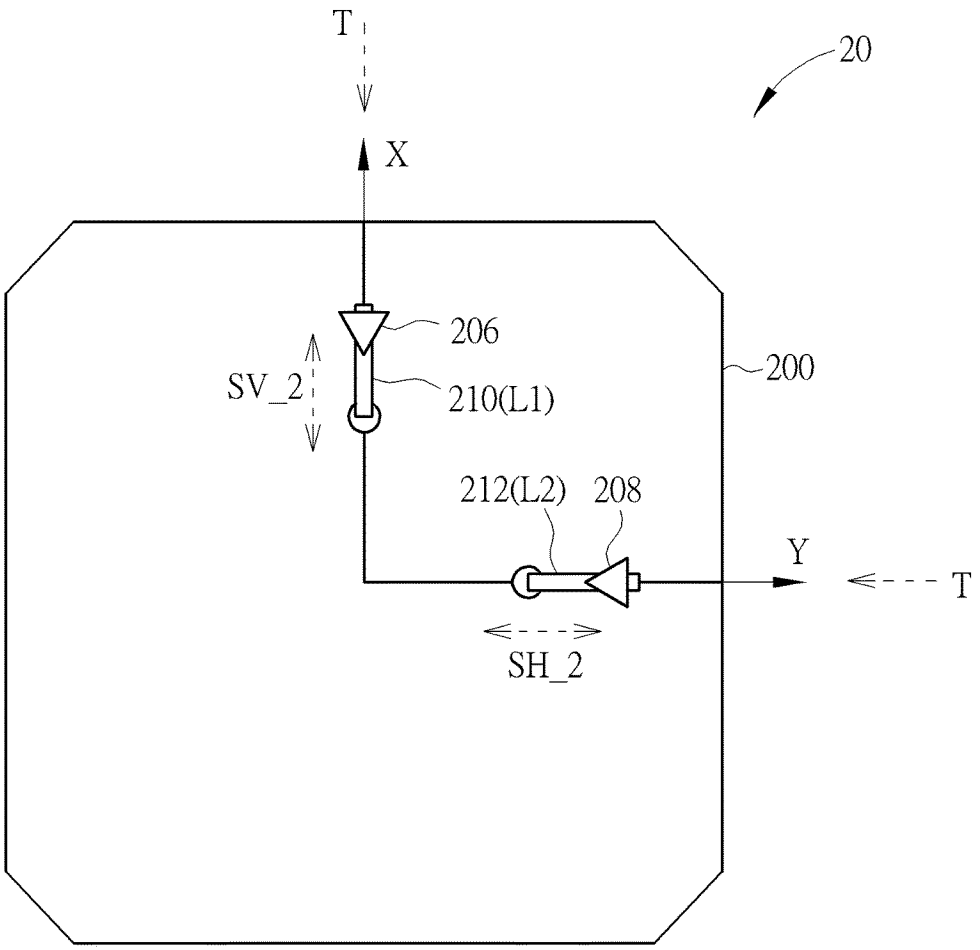
FIG. 3 is a schematic diagram of a back of the microstrip antenna transceiver in FIG. 2.
Figure 4:
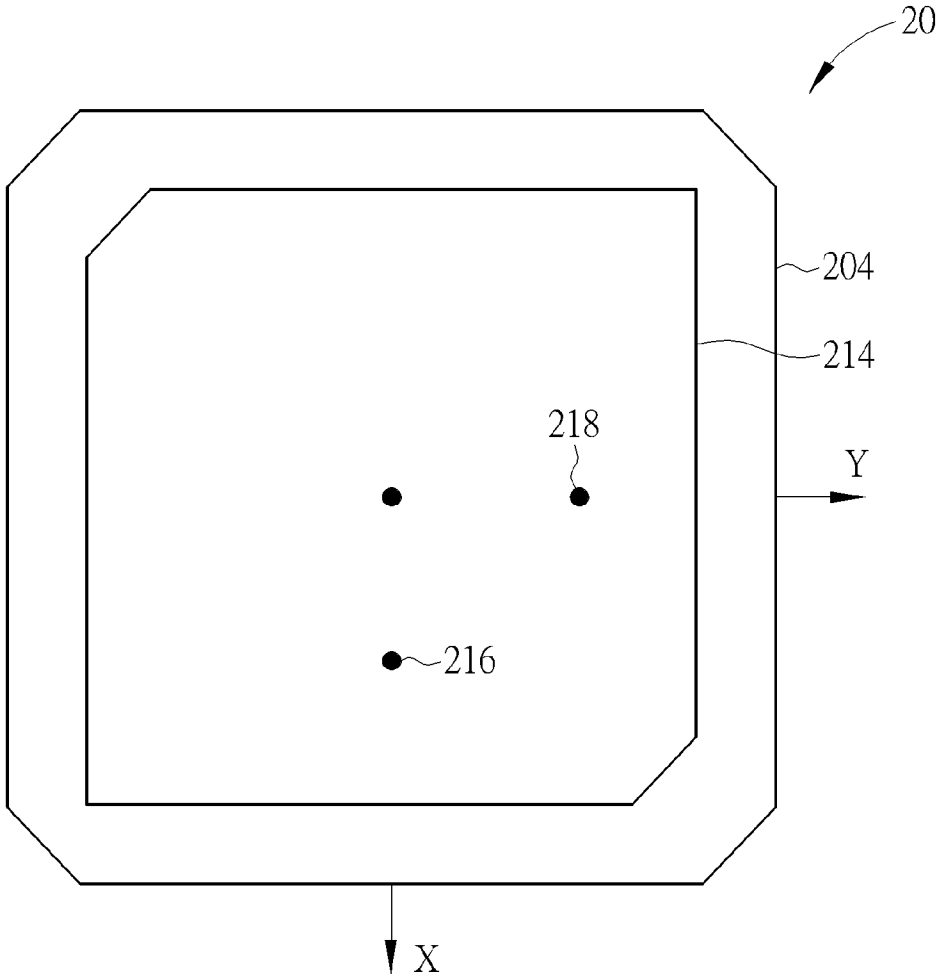
FIG. 4 is a schematic diagram of a front of the microstrip antenna transceiver in FIG. 2.

Please refer to FIG. 2-4. FIG. 2 is a schematic diagram of a side of a microstrip antenna transceiver 20 according to an embodiment of the present invention; FIG. 3 is a schematic diagram of a back of the microstrip antenna transceiver 20 in FIG. 2; and FIG. 4 is a schematic diagram of a front of the microstrip antenna transceiver 20 in FIG. 2. The microstrip antenna transceiver 20 includes a base board 200, a ground metal plate 202, an antenna module 204, a first switch 206, a second switch 208, a first microstrip wire 210, and a second microstrip wire 212. The ground metal plate 202 is disposed between the antenna module 204 and the base board 200. The ground metal plate 202 and the antenna module 204 are disposed on a surface of the base board 200 and the first switch 206 and the second switch 208 are disposed on another surface of the base board 200. The antenna module 204 includes a radiating metal patch 214, a vertically polarized feeding hole 216 and a horizontally polarized feeding hole 218. The first microstrip wire 210 is electrically connected between the vertically polarized feeding hole 216 and the first switch 206, and the second microstrip wire 212 is electrically connected between the horizontally polarized feeding hole 218 and the second switch 208. Besides, the shape of the radiating metal patch 214 of the antenna module 204 is a hexagon, and more precisely, formed by a quadrilateral cutting two opposite corners, for controlling the energy transformation between a vertically polarized signal SV_2 and a horizontally polarized signal SH_2 of the antenna module 204

In brief, the microstrip antenna transceiver 20 transmits or receives signals with different polarizations (i.e. left-handed polarized signal and the right-handed polarized signal) by controlling the first switch 206 and the second switch 208, so that the microstrip antenna transceiver 20 can handle the signals with different polarizations by the switching operations, to save the cost and handle the signals with different polarizations by using the same one antenna transceiver.

Please further refer to FIG. 3 and FIG. 4, which are schematic diagram of a back and a front of the microstrip antenna transceiver 20. As shown in FIG. 3, the first switch 206 is disposed on a vertical direction X and the second switch is disposed on a horizontal direction Y. The first switch 206 electrically connects to the vertically polarized feeding hole 216 via the first microstrip wire 210 to control the antenna module 204 to transmit or receive the vertically polarized signal SV_2. The second switch 208 electrically connects to the horizontally polarized feeding hole 218 via the second microstrip wire 212 to control the antenna module 204 to transmit or receive the horizontally polarized signal SH_2.

For the operations of transmitting a signal T, when the first switch 206 is conducted but the second switch 208 is off (i.e. the second switch 208 is not conducted), the signal T enters the microstrip antenna transceiver 20 from the first switch 206 and is fed to the vertically polarized feeding hole 216 via the first microstrip wire 210 so as to generate the vertically polarized signal SV_2 in the antenna module 204 and radiate the vertically polarized signal SV_2 on the air. However, since the radiating metal patch 214 has two cutting corners, part of the signal T would be transformed into the horizontally polarized signal SH_2. The transformed horizontally polarized signal SH_2 further enters the horizontally polarized feeding hole 218 to reach the off-status second switch 208 by way of the second microstrip wire 212 and reflects back to the horizontally polarized feeding hole 218, so that the antenna module 204 generates the horizontally polarized signal SH_2 and radiates the horizontally polarized signal SH_2 on the air. Note that, the microstrip antenna transceiver 20 can adjust the cutting corners of the radiating metal patch 214 or displacements of the vertically polarized feeding hole 216 and the horizontally polarized feeding hole 218 to make the energies of the vertically polarized signal SV_2 and the horizontally polarized signal SH_2 be equal, and further adjust the length L2 of the second microstrip wire 212 to make the vertically polarized signal SV_2 lead 90 degrees to the horizontally polarized signal SH_2, to generate the left-handed polarized antenna pattern. Besides, an antenna dimension and an electromagnetic field solution can be obtained when the reflection phase of the second switch 208 of the microstrip antenna transceiver 20 is 180 degrees. Then, when the reflection phase of the second switch 208 of the microstrip antenna transceiver 20 is not 180 degrees, the reflection phase can be adjusted to 180 degrees by adjusting the length L2 of the second microstrip wire 212. In other words, the microstrip antenna transceiver 20 can adjust the length L2 of the second microstrip wire 212 to the 180-degree reflection phase so as to obtain the same electromagnetic field solution without changing the antenna dimension.

For the same reason, when the second switch 208 is conducted but the first switch 206 is off, the signal T enters the microstrip antenna transceiver 20 from the second switch 208 and is fed to the horizontally polarized feeding hole 218 via the second microstrip wire 212 so as to generate the horizontally polarized signal SH_2 in the antenna module 204 and radiate the horizontally polarized signal SH_2 on the air. However, since the radiating metal patch 214 has two cutting corners, part of the signal T would be transformed into the vertically polarized signal SV_2. The transformed vertically polarized signal SV_2 further enters the vertically polarized feeding hole 216 to reach the off-status first switch 206 byway of the first microstrip wire 210 and reflects back to the vertically polarized feeding hole 216, so that the antenna module 204 generates the vertically polarized signal SV_2 and radiates the vertically polarized signal SV_2 on the air. Note that the microstrip antenna transceiver 20 can adjust the cutting corners of the radiating metal patch 214 or displacements of the vertically polarized feeding hole 216 and the horizontally polarized feeding hole 218 to make the energies of the vertically polarized signal SV_2 and the horizontally polarized signal SH_2 be equal, and further adjust the length L1 of the first microstrip wire 210 to make the vertically polarized signal SV_2 lag 90 degrees to the horizontally polarized signal SH_2, to generate the right-handed polarized antenna pattern. Identically, when the reflection phase of the first switch 206 of the microstrip antenna transceiver 20 is not 180 degrees, the reflection phase can be adjusted to 180 degrees by adjusting the length L1 of the first microstrip wire 210. In other words, the microstrip antenna transceiver 20 can adjust the length L1 of the first microstrip wire 210 to the 180-degree reflection phase so as to obtain the same electromagnetic field solution without changing the antenna dimension. Note that, the first switch 206 and the second switch 208 can be performed by transistors or diode elements, but not limited herein.

Moreover, for the receiving operations, via controlling the first switch 206 and the second switch 208, the microstrip antenna transceiver 20 can also transmit the left-handed polarized signal or the right-handed polarized signal received from the antenna module 204 to a backend circuit module (which is not illustrated on FIG. 2 to FIG. 4) to perform signal processing. Besides, in comparison with the radiating operations, the first switch 206 and the second switch 208 need to rotate 180 degrees to conform the signal transmission directions when the receiving operations are executed.

Figure 5:
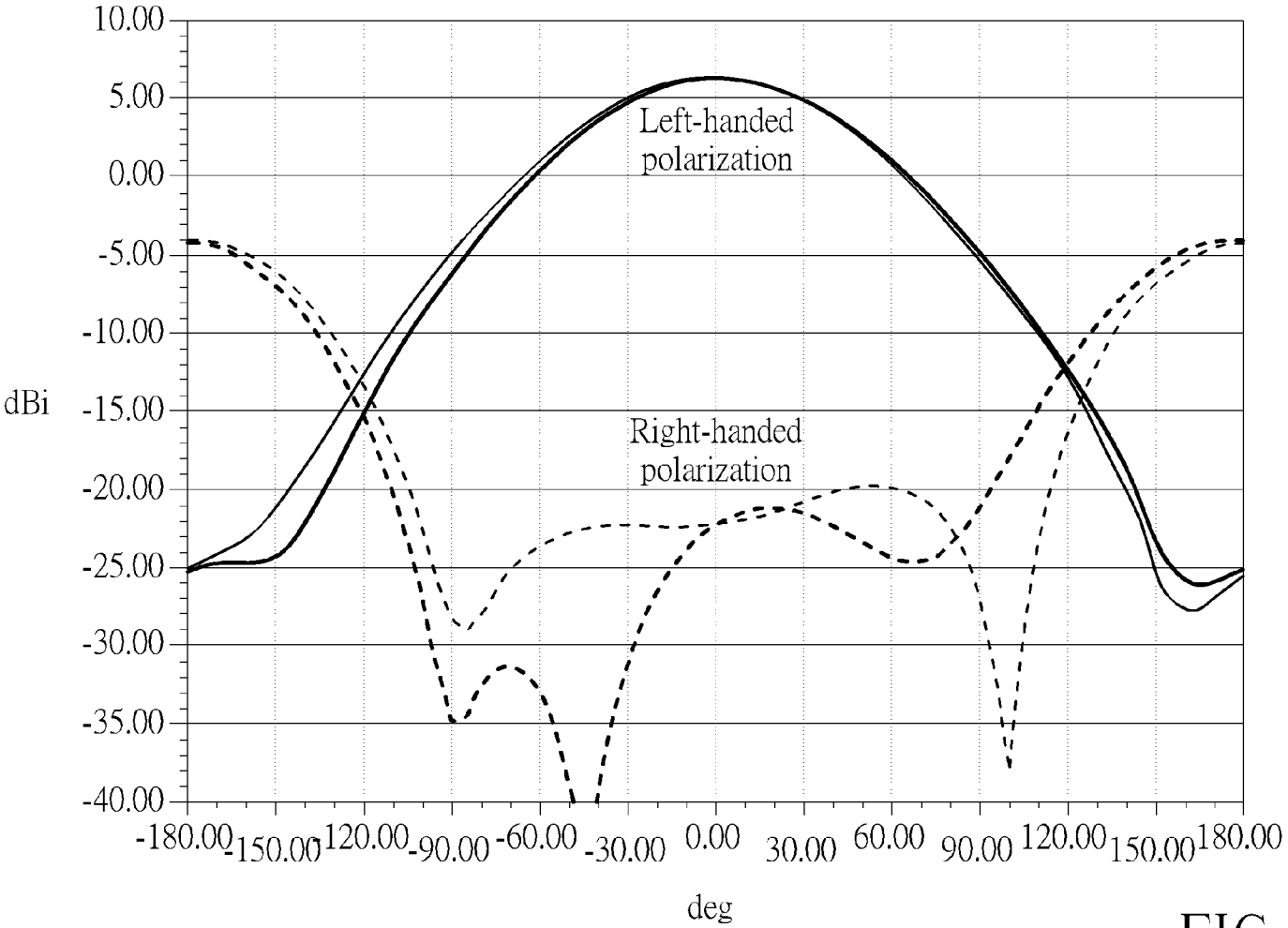
FIG. 5 is a schematic diagram of the antenna pattern of the microstrip antenna transceiver feeding the signal into the first switch in FIG. 2.
Figure 6:
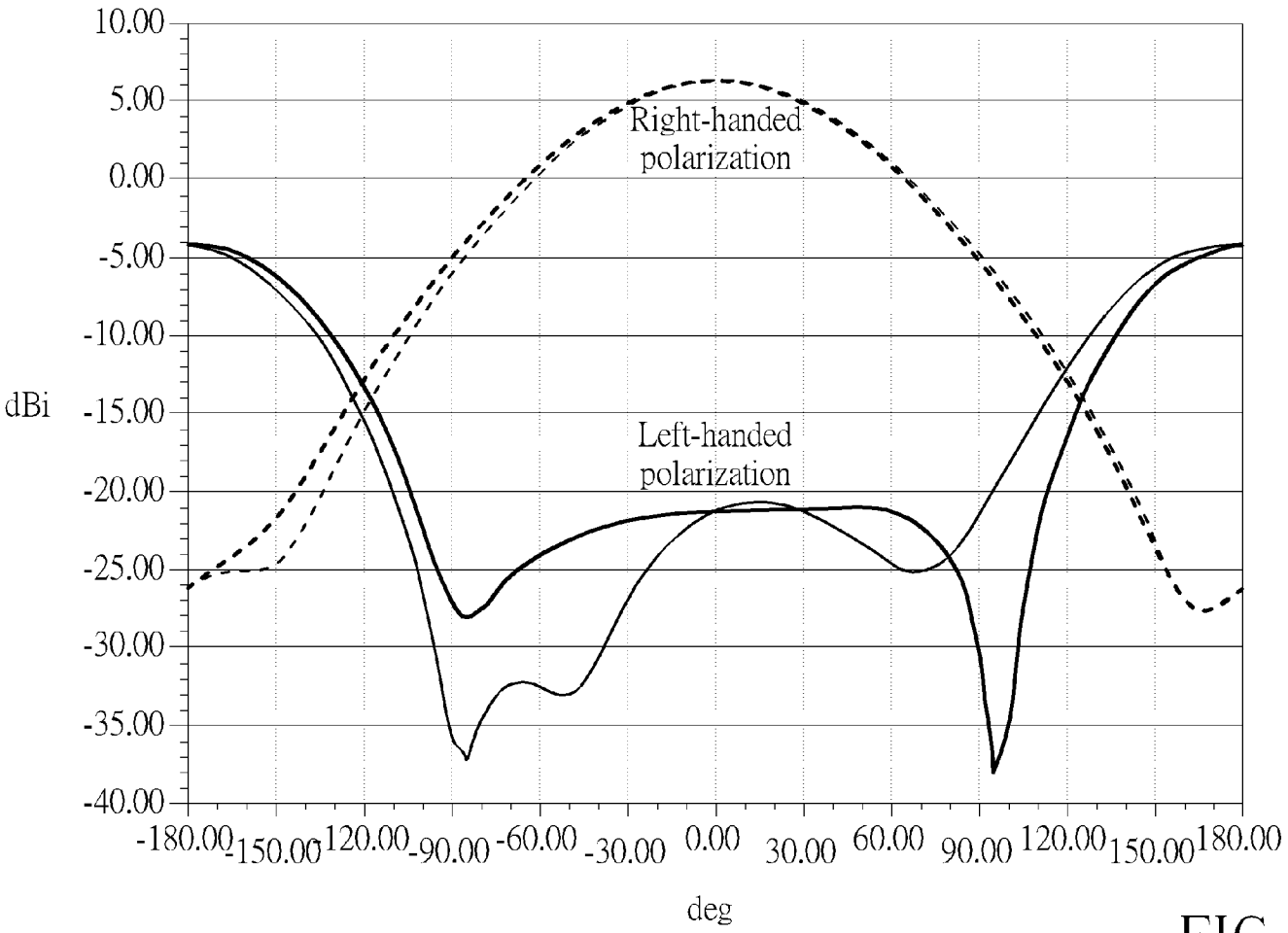
FIG. 6 is a schematic diagram of the antenna pattern of the microstrip antenna transceiver feeding the signal into the second switch in FIG. 2.

Please refer to FIG. 5 and FIG. 6. FIG. 5 is a schematic diagram of the antenna pattern of the microstrip antenna transceiver 20 feeding the signal into the first switch 206 in FIG. 2. FIG. 6 is a schematic diagram of the antenna pattern of the microstrip antenna transceiver 20 feeding the signal into the second switch 208 in FIG. 2. As shown in FIG. 5, the antenna pattern of the signal fed from the first switch 206 is left-handed polarized. As shown in FIG. 6, the antenna pattern of the signal fed from the second switch 208 is right-handed polarized. Therefore, the microstrip antenna transceiver 20 of the embodiment in the present invention can control the feeding points for signals, to handle the different polarized signals.

The microstrip antenna transceiver 20 is an example of the present invention. Those skilled in the art should readily make combinations, modifications and/or alterations on the abovementioned description and examples. For example, please continue to refer to FIG. 7 and FIG. 8. FIG. 7 is a schematic diagram of a back of a microstrip antenna transceiver 70 according to an embodiment of the present invention. FIG. 8 is a schematic diagram of a front of the microstrip antenna transceiver 70 in FIG. 7. The structures of the microstrip antenna transceivers 20 and 70 are substantially the same. The difference between the microstrip antenna transceivers 20 and 70 is that the microstrip antenna transceiver 70 uses a displacement of the feeding points to control the energy transformation of the vertically polarized signal SV_2 and the horizontally polarized signal SH_2. The first switch 206 is used for adjusting the position of the vertically polarized feeding hole 216 along a direction Z, wherein the direction Z and the vertical direction X form a first angle θ1. The position of the vertically polarized feeding hole 216 and a position in the direction Z have displacements in the horizontal direction Y. Moreover, the second switch 208 is used for adjusting the position of the horizontally polarized feeding hole 218 along a direction W, wherein the direction W and the opposite direction of the vertical direction X form a second angle θ2. The position of the horizontally polarized feeding hole 218 and a position in the direction W have displacements in the horizontal direction Y. The first angle θ1 and the second angle θ2 may be set to 45 degrees. In addition, the radiating metal patch 214 retains symmetric without the cutting corners. The microstrip antenna transceiver 70 only needs to adjust the displacements of the vertically polarized feeding hole 216 and the horizontally polarized feeding hole 218 and the lengths of the first microstrip wire 210 and the second microstrip wire 212, to achieve the abovementioned antenna pattern.

Please continue to refer to FIG. 9 and FIG. 10. FIG. 9 is a schematic diagram of the antenna pattern of the microstrip antenna transceiver 70 feeding the signal into the first switch 206. FIG. 10 is a schematic diagram of the antenna pattern of the microstrip antenna transceiver 70 feeding the signal into the second switch 208. As shown in FIG. 9, the antenna pattern of the signal fed from the first switch 206 is left-handed polarized. As shown in FIG. 10, the antenna pattern of the signal fed from the second switch 208 is right-handed polarized. Therefore, the microstrip antenna transceiver 70 of the embodiment in the present invention can control the feeding points for signal, to handle the different polarized signals.

AS seen above, the microstrip antenna transceiver of the present invention transmits or receives signals with different polarizations in different time and saves the cost by controlling switches and adjusting cutting corners of radiating metal patch, displacements of feeding holes or lengths of microstrip wires connected between switches and feeding holes.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A microstrip antenna transceiver with switchable polarizations, used in a satellite signal reception device, comprising:

a base board, comprising a first surface and a second surface;

a ground metal plate, disposed on the first surface of the base board;

an antenna module, disposed on the ground metal plate, comprising a radiating metal patch, a vertically polarized feeding hole and a horizontally polarized feeding hole;

a first switch, disposed on the second surface of the base board;

a second switch, disposed on the second surface of the base board;

a first microstrip wire, electrically connected between the vertically polarized feeding hole of the antenna module and the first switch; and a second microstrip wire, electrically connected between the horizontally polarized feeding hole of the antenna module and the second switch;

wherein the radiating metal patch of the antenna module has a six-sided shape, and two opposite corners of a quadrilateral is trimmed to form the six-sided shape;

wherein the vertically polarized feeding hole and the horizontally polarized feeding hole are symmetrical with respect to a diagonal line connecting the two opposite corners;

wherein the first switch and the second switch do not electrically connect to the ground metal plate.

2. The microstrip antenna transceiver of claim 1, wherein the vertically polarized feeding hole is set on the first surface of the base board and set on a first location of a first direction along the first direction, the horizontally polarized feeding hole is set on the first surface of the base board and set on a second location of a second direction along the second direction, and the first direction is substantially vertical to the second direction.

3. The microstrip antenna transceiver of claim 2, wherein a shape of the radiating metal patch of the antenna module is a hexagon formed by a quadrilateral cutting two opposite corners.

4. The microstrip antenna transceiver of claim 1, wherein the microstrip antenna transceiver feeds a signal into the vertically polarized feeding hole via the first switch cooperating with the first microstrip wire, to generate a left-handed polarized signal.

5. The microstrip antenna transceiver of claim 1, wherein the microstrip antenna transceiver feeds a signal into the horizontally polarized feeding hole via the second switch cooperating with the second microstrip wire, to generate a right-handed polarized signal.

6. The microstrip antenna transceiver of claim 1, wherein the first switch and the second switch are transistors or diodes elements.

7. The microstrip antenna transceiver of claim 1, wherein when the first switch is conducted, a signal connection from the first switch, through the first microstrip wire and the vertically polarized feeding hole, to the radiating metal patch is established, and when the second switch is conducted, another signal connection from the second switch, through the second microstrip wire and the horizontally polarized feeding hole, to the radiating metal patch is established.

8. The microstrip antenna transceiver of claim 1, wherein the first switch is utilized for receiving a first signal, and the second switch is utilized for receiving a second signal; wherein when the first switch is conducted, the first switch transmits the received first signal to the vertically polarized feeding hole through the first microstrip wire, so as to feed the first signal to the radiating metal patch, and when the second switch is conducted, the second switch transmits the received second signal to the horizontally polarized feeding hole through the second microstrip wire, so as to feed the second signal to the radiating metal patch.

9. A microstrip antenna transceiver with switchable polarizations, used in a satellite signal reception device, comprising:

a base board, comprising a first surface and a second surface;

a ground metal plate, disposed on the first surface of the base board;

an antenna module, disposed on the ground metal plate, comprising a radiating metal patch, a vertically polarized feeding hole and a horizontally polarized feeding hole;

a first switch, disposed on the second surface of the base board;

a second switch, disposed on the second surface of the base board;

a first microstrip wire, electrically connected between the vertically polarized feeding hole of the antenna module and the first switch; and a second microstrip wire, electrically connected between the horizontally polarized feeding hole of the antenna module and the second switch;

wherein the vertically polarized feeding hole is set on the first surface of the base board and set on a third location comprising a first displacement with a location of a third direction along the third direction, the horizontally polarized feeding hole is set on the first surface of the base board and set on a fourth location comprising a second displacement with a location of a fourth direction along the fourth direction, and the third direction is substantially vertical to the fourth directions;

wherein the first switch and the second switch do not electrically connect to the ground metal plate.

10. The microstrip antenna transceiver of claim 9, wherein the microstrip antenna transceiver feeds a signal into the vertically polarized feeding hole via the first switch cooperating with the first microstrip wire, to generate a left-handed polarized signal.

11. The microstrip antenna transceiver of claim 9, wherein the microstrip antenna transceiver feeds a signal into the horizontally polarized feeding hole via the second switch cooperating with the second microstrip wire, to generate a right-handed polarized signal.

12. The microstrip antenna transceiver of claim 9, wherein the first switch and the second switch are transistors or diodes elements.

13. The microstrip antenna transceiver of claim 9, wherein when the first switch is conducted, a signal connection from the first switch, through the first microstrip wire and the vertically polarized feeding hole, to the radiating metal patch is established, and when the second switch is conducted, another signal connection from the second switch, through the second microstrip wire and the horizontally polarized feeding hole, to the radiating metal patch is established.

14. The microstrip antenna transceiver of claim 9, wherein the first switch is utilized for receiving a first signal, and the second switch is utilized for receiving a second signal; wherein when the first switch is conducted, the first switch transmits the received first signal to the vertically polarized feeding hole through the first microstrip wire, so as to feed the first signal to the radiating metal patch, and when the second switch is conducted, the second switch transmits the received second signal to the horizontally polarized feeding hole through the second microstrip wire, so as to feed the second signal to the radiating metal patch.

* * * * *